US005630394A

United States Patent [19]

Grizzle et al.

[11] Patent Number: 5,630,394

[45] Date of Patent: May 20, 1997

[54] IDLE SPEED CONTROL

[75] Inventors: Jessy W. Grizzle, Ann Arbor; Jing Sun, Novi, both of Mich.

[73] Assignee: Ford Motor Company, Dearborn, Mich.

[21] Appl. No.: 610,777

[22] Filed: Mar. 4, 1996

[51] Int. Cl.[6] ..... F02D 41/16

[52] U.S. Cl. ..... 123/339.23; 123/339.19

[58] Field of Search ..... 123/339.19, 339.23, 123/339.26

[56] References Cited

U.S. PATENT DOCUMENTS

| | | | |
|---|---|---|---|
| 4,438,744 | 3/1984 | Hasegawa | 123/327 |
| 4,788,954 | 12/1988 | Otobe et al. | 123/327 |
| 4,799,466 | 1/1989 | Shibata et al. | 123/327 |
| 5,213,076 | 5/1993 | Umemoto et al. | 123/327 |
| 5,261,368 | 11/1993 | Umemoto | 123/327 |
| 5,517,964 | 5/1996 | Chen et al. | 123/339.11 |

*Primary Examiner*—Tony M. Argenbright
*Attorney, Agent, or Firm*—Allan J. Lippa

[57] ABSTRACT

A speed control system is shown for an internal combustion engine (10) having an intake manifold (44) and throttling device (96) connected thereto in parallel with the main throttle plate (62). After an idle speed command is detected (200), the engine (10) is decelerated (204–230) to a preselected speed by adjusting the throttling device (96) to concurrently force both engine speed and engine acceleration within a predetermined acceleration/speed range(s). When the preselected speed is reached, engine speed is regulated (300–328) to a desired idle speed by adjusting the throttling device (96) to force a difference between the engine and idle speed towards zero.

10 Claims, 5 Drawing Sheets

IDLE SPEED CONTROL

BACKGROUND OF THE INVENTION

The field of the invention relates to engine speed control systems. More specifically, the field relates to smoothly decelerating an engine to an idle speed.

Engine idle speed control systems are known which control idle speed by controlling the amount of air inducted through a bypass passageway arranged in parallel with the main throttle plate. It is also known to use the bypass air control to smooth engine deceleration from an engine speed significantly above idle towards an idle speed in a predetermined, preprogrammed manner. An example of such a control system is shown in U.S. Pat. No. 5,261,368.

The inventors herein have recognized numerous problems with the above approach. They have found that by decelerating the engine in a preprogrammed manner, speed undershoot or speed overshoot from a desired vehicle speed may result. For example, the required air flow to bring the engine speed down smoothly to the idle region is different for different load and operational conditions such as temperature, speed ranges, road terrain, and it may also vary with vehicle aging. In addition, the rate of deceleration may be unsatisfactory over all load and speed conditions.

SUMMARY OF THE INVENTION

An object of the invention herein is to provide feedback control to smoothly decelerate an engine to an idle speed without undershooting or overshooting the idle speed.

The above object is achieved, and problems of prior approaches overcome, by providing both a control method and a control system for an internal combustion engine having an intake manifold and a throttle device connected thereto. In one particular aspect of the invention, the method comprises the steps of: detecting an operator actuated engine idle speed command; detecting engine speed and engine acceleration; decelerating the engine to a preselected engine speed in response to the idle speed command detection by adjusting the throttling device to concurrently force both the detected engine speed and the detected engine acceleration within a predetermined acceleration and speed range so that, both the detected engine deceleration and the detected engine speed occurs within the range; and regulating the detected engine speed after the preselected engine speed is detected to maintain the detected engine speed at a desired idle speed by adjusting the throttling device to force a difference between the detected engine speed and the desired engine speed towards zero.

An advantage of the above aspect of the invention is that by using feedback control to force the combination of engine acceleration and engine speed to be within a preselected range, smooth engine deceleration is provided to an idle speed without undershooting or overshooting the idle speed. Another advantage is that adjustments to the throttling device are minimized.

DESCRIPTION OF AN EXAMPLE OF OPERATION

Figure 1A:
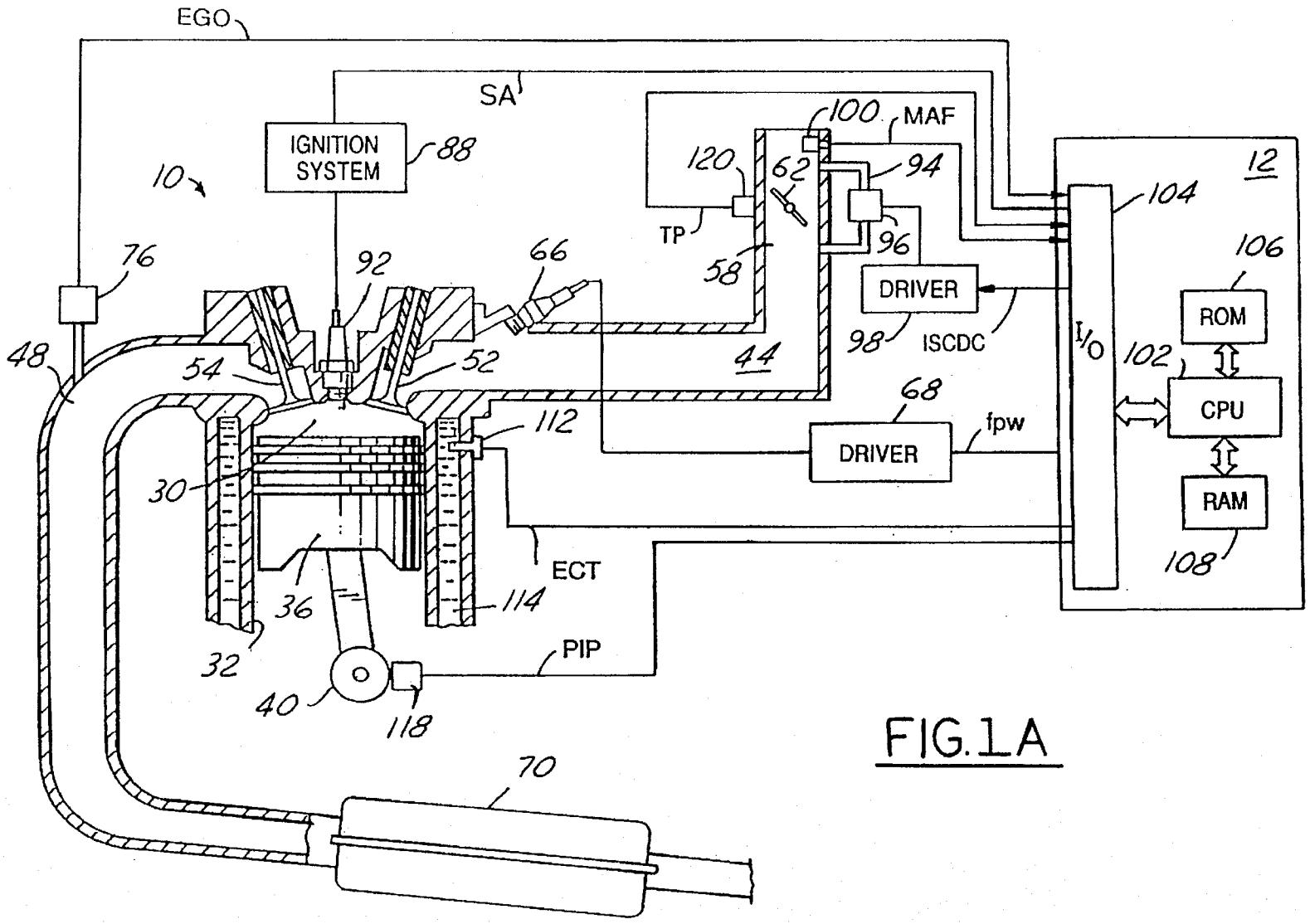
FIG. 1A shows a first embodiment of the invention.

Internal combustion engine 10 comprising a plurality of cylinders, one cylinder of which is shown in FIG. 1A, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. In this particular embodiment, throttle plate 62 is coupled to an operator actuated accelerator pedal (not shown) via a conventional throttle cable (not shown).

Intake manifold 44 is also shown having fuel injector 66 coupled thereto for delivering liquid fuel in proportion to the pulse width of signal fpw received from controller 12 via conventional electronic driver 68. Fuel is delivered to fuel injector 66 by a conventional fuel system (not shown) including a fuel tank, fuel pump, and fuel rail.

Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is selected at stoichiometry which falls within the peak efficiency window of catalytic converter 70.

In the particular embodiment shown in FIG. 1A, idle bypass passageway 94 is shown coupled to throttle body 58 in parallel with throttle plate 62 to provide air to intake manifold 44 via bypass throttling device 96 independently of the position of throttle plate 62. In this particular example, bypass throttling device 96 is a conventional electronically actuated solenoid valve. Controller 12 provides pulse width modulated signal ISCDTY to the solenoid valve via electronic driver 98 so that airflow is inducted through bypass passageway 94 at a rate proportional to the duty cycle of signal ISCDTY.

Conventional distributorless ignition system 88 provides ignition spark to combustion chamber 30 via spark plug 92 in response to spark advance signal SA from controller 12.

Controller 12 is shown in FIG. 1 as a conventional microcomputer including: microprocessor unit 102, input/output ports 104, an electronic storage medium for storing executable programs and calibration values shown as memory chip 106 in this particular example, random access memory 108, and a conventional data bus. Controller 12 is shown receiving various signals from sensors coupled to engine 10, in addition to those signals previously discussed, including: measurements of inducted mass air flow (MAF) from mass air flow sensor 100 which is coupled to throttle body 58 upstream of air bypass passageway 94 to provide a total measurement of airflow inducted into intake manifold 44 via both throttle body 58 and bypass passageway 94; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 120.

Figure 1B:
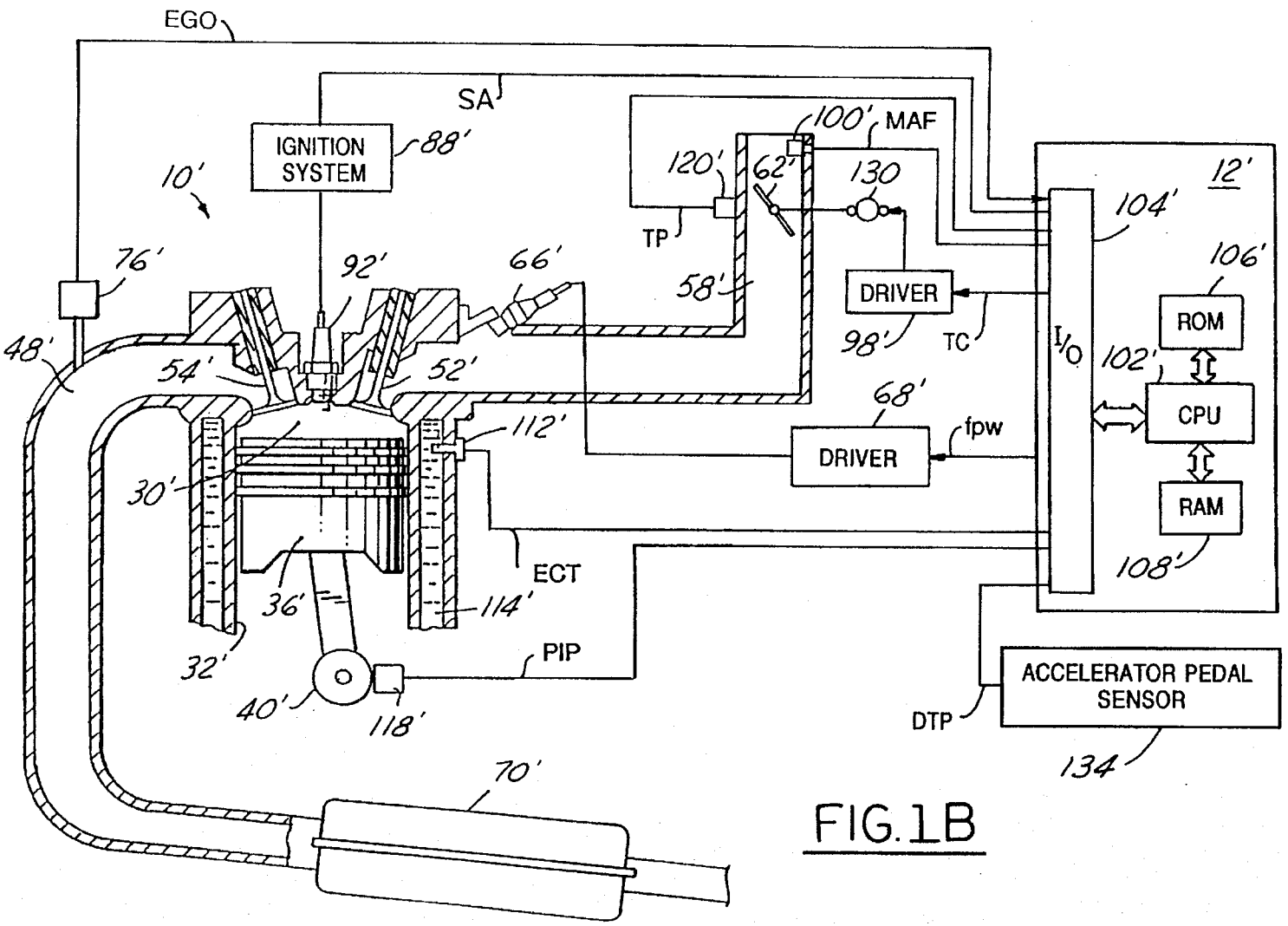
FIG. 1B shows a second embodiment of the invention.

An alternate embodiment is shown in FIG. 1B wherein like numerals refer to like parts shown in FIG. 1A. In general the differences between the two embodiments relate to the manner in which throttle plate 62 is controlled. The embodiment of FIG. 1A describes throttle plate 62 as mechanically coupled to the accelerator pedal. On the other hand, the embodiment shown in FIG. 1B describes an electronically controlled throttle plate 62'.

Referring to FIG. 1B in greater detail, throttle plate 62' is shown controlled by stepper motor 130' which in turn is controlled by throttle command signal TC from electronic engine controller 12' via electronic driver 98'. Throttle command signal TC is a conventional three-phase conversion by controller 12 of desired throttle position signal DTP from accelerator pedal sensor 134'. The three-phase signal drives stepper motor 130' in a conventional manner. In this particular example, accelerator pedal sensor 134' is coupled to an operator actuated accelerator pedal (not shown) to provide an electronic representation (signal DTP) of the accelerator pedal position.

Figure 2:
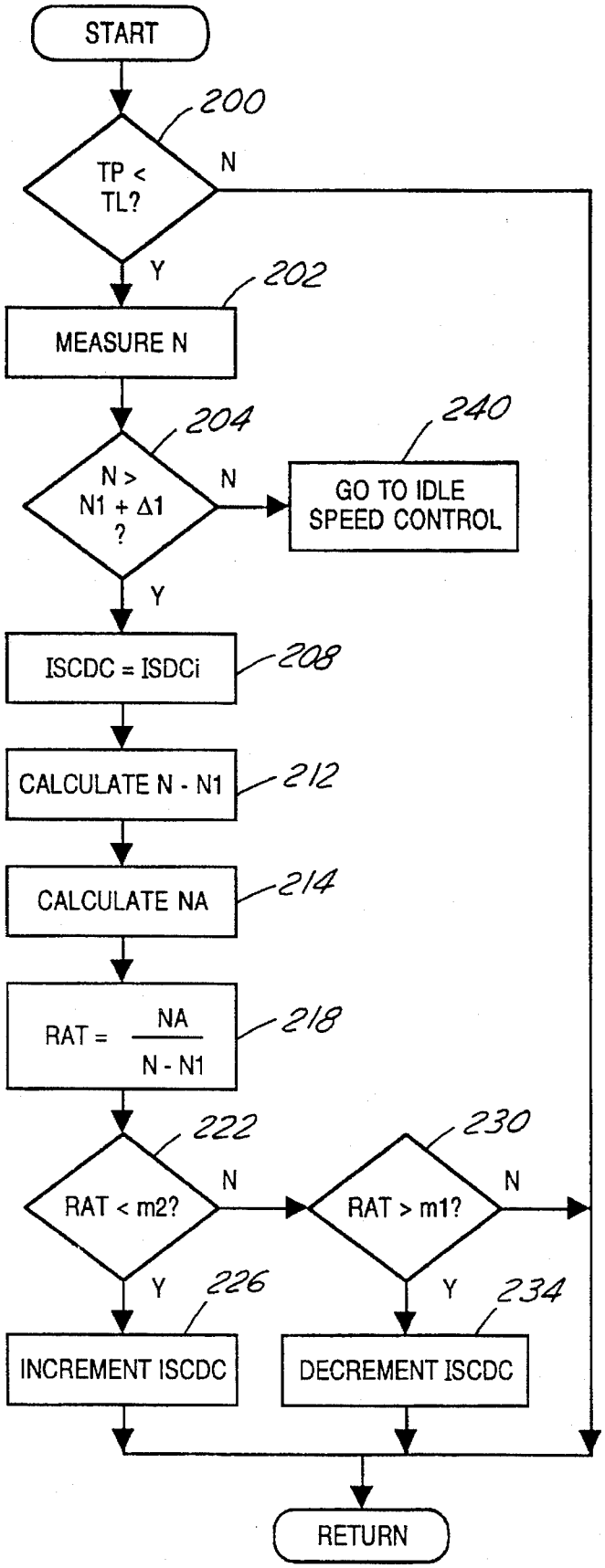
FIG. 2 shows a deceleration control subroutine.

A description of decelerating engine 10 by using either throttling device 96 (shown in FIG. 1A) or the electronic throttle control using stepper motor 130' (shown in FIG. 1B) is now described with reference to FIG. 2. The subroutine commences when an operator actuated engine idle speed command is detected. For the examples presented herein, such detection occurs when throttle position TP is less than lower limit TL as shown in step 202. For the particular embodiment shown in FIG. 1A, throttle position TP is detected by throttle position sensor 120. And for the particular embodiment shown in FIG. 1B, throttle position TP is provided by desired throttle position DTP from accelerator pedal sensor 134'. In still another example of operation which is possible with the embodiment shown in FIG. 1B, throttle position TP may be provided from throttle command TC generated by controller 12'.

During step 202, engine speed N is measured or detected by counting signal PIP from sensor 118 in a conventional manner. When throttle position TP is less than lower limit TL, engine speed N is compared to engine speed N1+Δ1 (step 204). In this particular example, engine speed N1 is selected as being less than desired engine speed DIS. When engine speed N is greater than engine speed N1+Δ1, idle speed control duty cycle signal ISCDC is set equal to initial value ISDCi (208). Initial idle speed duty cycle ISDCi is provided for a smoother transition from engine deceleration to engine idle.

The difference between detected engine speed N and predetermined engine speed N1 is calculated during step 212. And, engine acceleration NA is calculated during step 214. During step 218, ratio RAT of engine acceleration NA to the difference between engine speed N and predetermined engine speed N1 is calculated. If ratio RAT is less than range value m2 (step 222), idle speed duty cycle ISCDC is incremented by an amount related to RAT (step 226). When ratio RAT is greater than range value m1 (step 230), idle speed duty cycle ISCDC is decremented by an amount related to RAT (step 234).

Figure 3:
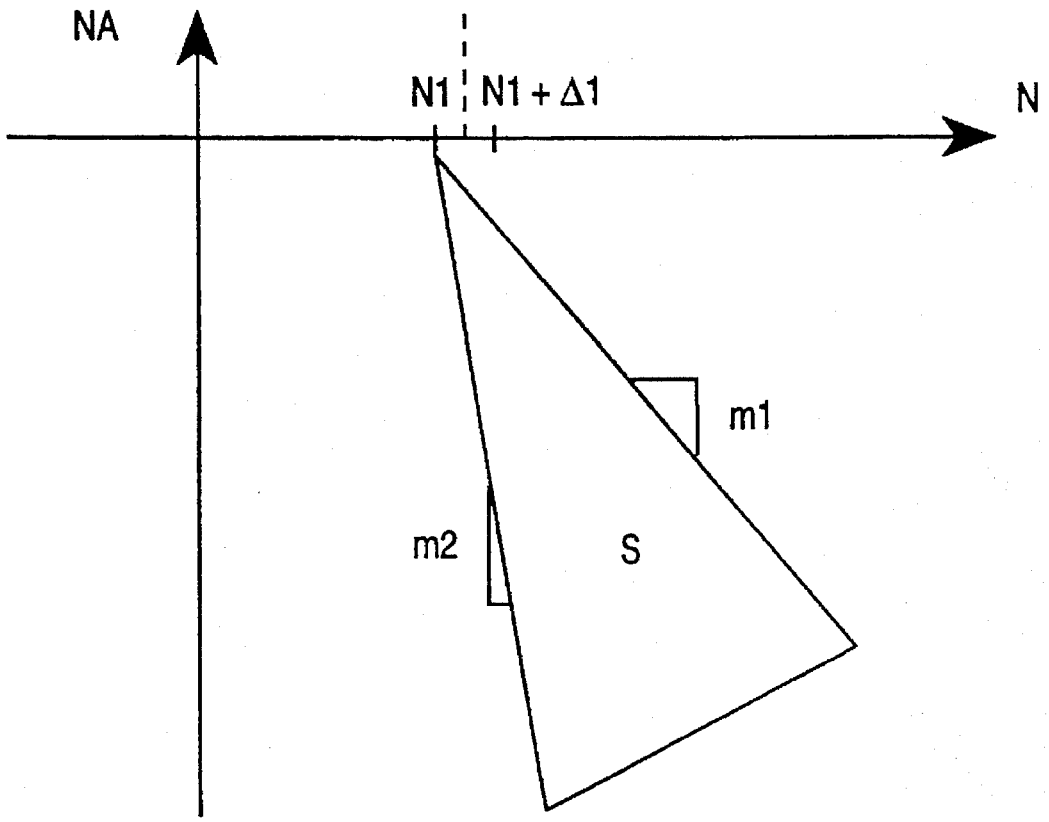
FIG. 3 shows engine acceleration graphed against engine speed.

The operation described above with particular reference to FIG. 2 provides smooth deceleration of engine 10 until a preselected engine speed is achieved at which time conventional idle speed control commences (steps 204, and 240). A graphical representation of this operation is shown in FIG. 3. More specifically, engine acceleration NA is graphed against engine speed N. The desired range for a combination of different engine accelerations and engine speeds is shown by the triangular sector labeled S. It is seen that desired range S converges to predetermined engine speed N1 when engine deceleration reaches zero.

When ratio RAT (which is negative number during deceleration) is less than range value m2 (which corresponds to the slope of the lower boundary of range S as shown in FIG. 3), engine 10 is accelerated to drive the combination of engine acceleration NA and engine speed N back into range S. Similarly, when ratio RAT is greater than range value m1 (which represents the slope of the upper boundary of range S shown in FIG. 3), engine 10 is decelerated to again drive engine speed N and engine acceleration NA into range S. In this manner, smooth engine deceleration is provided to speed N1+Δ1 without speed undershoot or speed overshoot.

Figure 4:
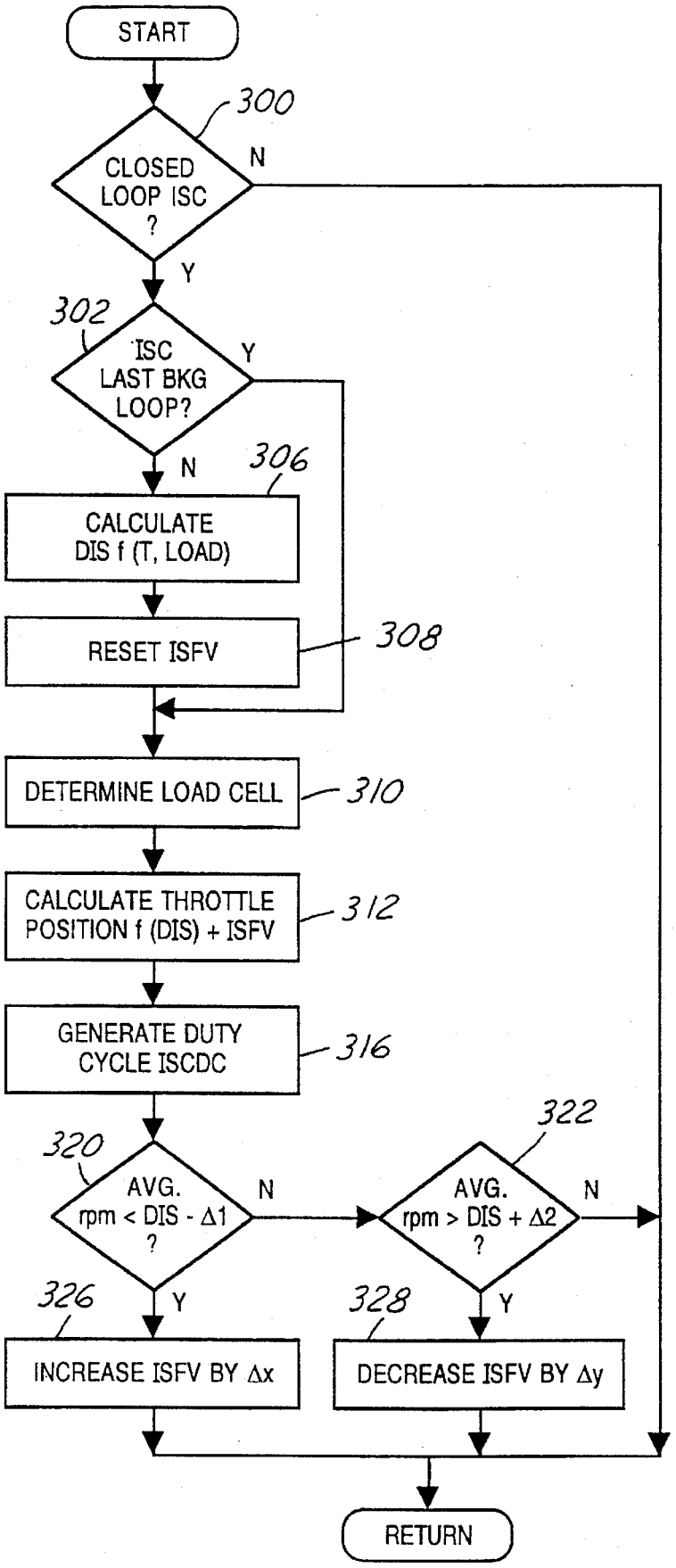
FIG. 4 shows background loop steps for controlling a throttling device.

When engine speed N reaches or falls below preselected engine speed N1+Δ1 (step 240 in FIG. 2), the conventional idle speed control shown in FIG. 4 commences. The idle speed feedback control routine performed by controller 12 is now described with particular reference to FIG. 4. Feedback or closed loop idle speed control (ISC) commences when preselected operating conditions are detected (see step 300). Typically such operating conditions are a closed primary throttle position and engine speed less than a preselected value. Closed throttle idling is thereby distinguished from closed throttle deceleration which was previously described herein with particular reference to FIGS. 2 and 3.

At the beginning of each idle speed control period (step 302), desired (or reference) idle speed DIS is calculated as a function of engine operating conditions such as engine speed (N) and coolant temperature (step 306). The previous idle speed feedback variable ISFV is also reset to zero (step 308) at the beginning of each idle speed control period.

After the above described initial conditions are established, the following steps (310–328) are performed each background loop of controller 12. During step 310, the appropriate load operating cell is selected to receive idle speed correction. Controller 12 then calculates desired throttle position for bypass throttling device 96 (step 312). The desired idling speed DIS at the beginning of the idle speed control period is converted into a bypass throttle position, by a look-up table in this example, and this initial throttle position is corrected by idle speed feedback variable ISFV, the generation of which is described below. Idle speed duty cycle ISDC for operating the solenoid valve (not shown), of bypass throttling device 96 is then calculated in step 316. This duty cycle moves the bypass throttle to the value calculated in step 312.

Controller 12, in this one example of operation, provides a dead band with hysteresis around desired idle speed DIS in steps 320 and 322. When average engine speed is less than the dead band (DIS minus Δ2), idle speed feedback variable ISFV is increased by predetermined amount Δx in step 326. When average engine speed is greater than the dead band (DIS plus Δ3), ISFV is decreased by predetermined amount Δy in step 328. Accordingly, ISFV will appropriately increase or decrease the bypass throttle position (see step 312) to maintain, on average, desired idle speed DIS.

Although one example of an embodiment which practices the invention has been described herein, there are numerous other examples which also could be described. For example, analog devices, or discrete IC's may be used to advantage rather than a computer. The invention is therefore to be defined only in accordance with the following claims.

What is claimed:

1. A control method for an internal combustion engine having an intake manifold and a throttling device connected thereto, comprising the steps of:

detecting an operator actuated engine idle speed command;

detecting engine speed and calculating engine acceleration;

decelerating the engine to a preselected engine speed in response to said idle speed command detection by adjusting the throttling device to concurrently force both said detected engine speed and said calculated engine acceleration within a predetermined acceleration and speed range so that, both said calculated engine deceleration and said detected engine speed occurs within said range; and regulating said detected engine speed after said preselected engine speed is detected to maintain said detected engine speed at a desired idle speed by adjusting said throttling device to force a difference between said detected engine speed and said desired engine speed towards zero.

2. The method recited in claim 1 wherein said idle speed command detection step further comprises a step of detecting position of a primary throttle valve coupled to the intake manifold.

3. The method recited in claim 1 wherein said idle speed command detection step further comprises a step of detecting position of an operator actuated accelerator pedal.

4. A control method for an internal combustion engine having an intake manifold and a throttling device connected thereto for regulating airflow inducted therein, comprising the steps of:

detecting an operator actuated engine idle speed command;

detecting engine speed and calculating engine acceleration;

calculating a ratio of said engine acceleration to a speed variable related to said detected engine speed;

decelerating the engine to a preselected engine speed in response to said idle speed command detection by adjusting the throttling device to concurrently force both said detected engine speed and said calculated engine acceleration within a predetermined acceleration and speed range by decreasing the inducted airflow when said ratio is less than a first preselected value and increasing said inducted airflow when said ratio is greater than a second preselected value so that both said calculated engine deceleration and said detected engine speed occur within said range; and regulating engine speed after said preselected engine speed is detected to maintain said detected engine speed at a desired idle speed by adjusting said throttling device in response to a difference between said detected engine speed and said desired engine speed to drive said difference towards zero.

5. The method recited in claim 4 further comprising a step of generating said speed variable related to said detected engine speed from a difference between said detected engine speed and a predetermined engine speed which is less than said preselected engine speed.

6. The method recited in claim 5 wherein said desired engine speed and said predetermined engine speed are substantially equal.

7. A control system for an internal combustion engine having an intake manifold and a throttling device connected thereto for regulating airflow inducted therein, comprising:

detecting means for detecting an operator actuated engine idle speed command;

an engine speed sensor coupled to the engine for detecting engine speed;

calculating means for calculating engine acceleration and for calculating a ratio of said engine acceleration to a difference between said detected engine speed and a predetermined engine speed which is less than said preselected engine speed;

adjustment means for adjusting the throttling device in response to said idle speed command detection to decelerate the engine to a preselected engine speed, said adjusting step forcing both said detected engine speed and said detected engine acceleration within a predetermined acceleration and speed range by decreasing the inducted airflow when said ratio is less than a first preselected value and increasing said inducted airflow when said ratio is greater than a second preselected value; and said adjustment means also adjusting said throttling device after said preselected engine speed is detected to maintain said detected engine speed at a desired idle speed, said adjustment means being responsive to a difference between said detected engine speed and said desired engine speed to force said difference towards zero.

8. The system recited in claim 7 further comprising a throttle plate coupled to the intake manifold and wherein the throttling device comprises a bypass passageway connected to the intake manifold in parallel with said throttle plate, said bypass passageway having a bypass valve positioned therein.

9. The system recited in claim 8 wherein said detecting means detects said operator actuated engine idle speed command by detecting a closed position of said throttle.

10. The system recited in claim 7 further comprising a throttle plate coupled to the intake manifold and wherein the throttling device comprises a stepper motor coupled to said throttle plate and responsive to an operator actuated accelerator pedal.

* * * * *